US008944943B2

(12) United States Patent
Heiberg

(10) Patent No.: US 8,944,943 B2
(45) Date of Patent: Feb. 3, 2015

(54) KNOB SIMULATING DEVICE FOR SPORTING EQUIPMENT

(71) Applicant: Eric Heiberg, Long Valley, NJ (US)

(72) Inventor: Eric Heiberg, Long Valley, NJ (US)

( * ) Notice: Subject to any disclaimer, the term of this patent is extended or adjusted under 35 U.S.C. 154(b) by 119 days.

(21) Appl. No.: 13/733,730

(22) Filed: Jan. 3, 2013

(65) Prior Publication Data

US 2013/0172136 A1 Jul. 4, 2013

Related U.S. Application Data

(60) Provisional application No. 61/582,844, filed on Jan. 4, 2012.

(51) Int. Cl.
*A63B 59/06* (2006.01)
*A63B 59/00* (2006.01)

(52) U.S. Cl.
CPC ..... *A63B 59/0074* (2013.01); *A63B 59/0029* (2013.01); *A63B 59/06* (2013.01); *A63B 2209/10* (2013.01); *A63B 59/0044* (2013.01)
USPC ..... 473/568; 473/457; 473/227

(58) Field of Classification Search
USPC ..... 473/457, 519, 520, 568, 437, 227, 256, 473/226
See application file for complete search history.

(56) References Cited

U.S. PATENT DOCUMENTS

| | | | | | |
|---|---|---|---|---|---|
| 2,091,458 | A | * | 8/1937 | Sleight | 16/421 |
| 3,469,839 | A | | 9/1969 | Pietronuto et al. | |
| 3,521,883 | A | * | 7/1970 | Hamilton | 473/437 |
| 4,588,191 | A | * | 5/1986 | Stewart | 473/256 |
| 4,804,181 | A | * | 2/1989 | Foster | 473/206 |
| 5,577,722 | A | * | 11/1996 | Glassberg | 473/457 |
| 5,624,114 | A | * | 4/1997 | Kelsey | 473/520 |
| 5,839,983 | A | * | 11/1998 | Kramer | 473/568 |
| 6,059,675 | A | * | 5/2000 | Finn | 473/568 |
| 6,083,116 | A | * | 7/2000 | Loredo | 473/256 |
| 6,234,924 | B1 | | 5/2001 | Washburn, Jr. | |
| 6,277,040 | B1 | * | 8/2001 | Randolph | 473/568 |
| D521,092 | S | * | 5/2006 | Morales | D21/753 |
| D523,105 | S | * | 6/2006 | Bernacchi et al. | D21/753 |
| 7,128,667 | B2 | * | 10/2006 | Nolan | 473/457 |
| 7,169,069 | B1 | | 1/2007 | Dalton et al. | |
| 7,201,683 | B2 | | 4/2007 | Estape et al. | |
| 7,588,500 | B2 | * | 9/2009 | Hoeckl et al. | 473/256 |
| 8,419,562 | B2 | * | 4/2013 | Marrero | 473/256 |
| D682,963 | S | * | 5/2013 | McLeod | D21/753 |
| 2001/0031674 | A1 | * | 10/2001 | McGinnis | 473/451 |
| 2013/0196800 | A1 | * | 8/2013 | Boatwright et al. | 473/568 |

OTHER PUBLICATIONS

Website advertisement, Easton Bat Choke, 2007, www://baseballrampage.com/display-product.asp.

* cited by examiner

*Primary Examiner* — Mark Graham
(74) *Attorney, Agent, or Firm* — Roger M. Rathbun

(57) ABSTRACT

A knob simulating device that can be affixed to a sporting good, such as a baseball bat. The knob simulating device encircles the shaft of the baseball bat and is made up of a plurality of components that mate together to surround and encase the entire periphery of the bat shaft. Each of the component parts has a hard exterior portion and a resilient interior portion for contacting and conforming to the circular outer surface of the baseball bat. The resilient interior portion is generally cylindrical and may have one or more deformable projections that retain the device along the circular outer surface of the baseball bat. There may be a plurality of deformable projections in the form of annular rings that can be angled so as to securely retain the knob simulating device in the desired location along the shaft of the baseball bat.

15 Claims, 4 Drawing Sheets

KNOB SIMULATING DEVICE FOR SPORTING EQUIPMENT

RELATED CASES

The present patent application is based upon and hereby claims priority to U.S. Provisional Patent Application 61/582,844, filed Jan. 4, 2012 and entitled "A HAND POSITIONING DEVICE".

BACKGROUND OF THE INVENTION

The field of the invention relates to sporting goods and, in particular, to sporting goods when a players hands grip an element having a circular cross section, such as a baseball bat or golf club.

A baseball bat has a barrel, a shaft, and a knob. The barrel is the portion of the bat that contacts the ball when the payer hits the ball. The shaft is the portion of the bat that is gripped by the player and the knob is a bulbous terminus to the shaft.

The knob provides the batter with a location to position his hands, and it also provides support for his grip.

In the game of baseball, a batter's success depends upon control of the bat and bat speed. One method of increasing the bat speed and improving bat control is to reposition the user's hands higher on the shaft of the bat. This process is known as choking up.

When children are learning how to bat, their coaches frequently instruct them to choke up on the bat. When the child chokes up, he no longer has the knob as a guide to position his hands and provide support for his grip. Not surprisingly, the child frequently moves his hands back down to rest on the knob. Also, not surprisingly, the next time he bats he may not recall where he placed his hands the last time he choked up, and may choke up to a different position, or not at all.

There is, currently, a device on the market by Easton-Bell Sports that comprises a thick rubber loop that fits around the bat shaft that produces a "Bat Choke", however, that product has a disadvantage in that it must be stretched over the knob of the bat. Because the rubber loop is thick it requires considerable force to stretch the device to allow the rubber loop to pass by the knob in installing the rubber loop on the shaft of the bat. That product also has an additional disadvantage in that it is not adjustably positionable along the shalt of the bat and it does not fit different bat shaft diameters.

Accordingly, there is a need for a better device and a method to assist baseball players to choke up on a bat that enables a player to position his hands repeatedly at the same position, to provide support for the players grip at a choked up position, to provide a simulation of a bat knob at an adjustable position on the bat shaft and to provide a device that will fit many different shaft diameters.

SUMMARY OF THE INVENTION

With the present invention, there is a device that encircles a shaft of a sporting good having a generally cylindrical outer surface. The device is comprised of a plurality of component parts that mate together to form a device that encircles the shaft with each component part having a hard exterior portion and a resilient interior portion for contacting and conforming to the generally cylindrical outer surface of the sporting good. There is a plurality of deformable projections that retain the device along the generally cylindrical outer surface of the sporting good.

These and other features and advantages of the present invention will become more readily apparent during the following detailed description taken in conjunction with the drawings herein.

DETAILED DESCRIPTION OF THE INVENTION

Figure 2:
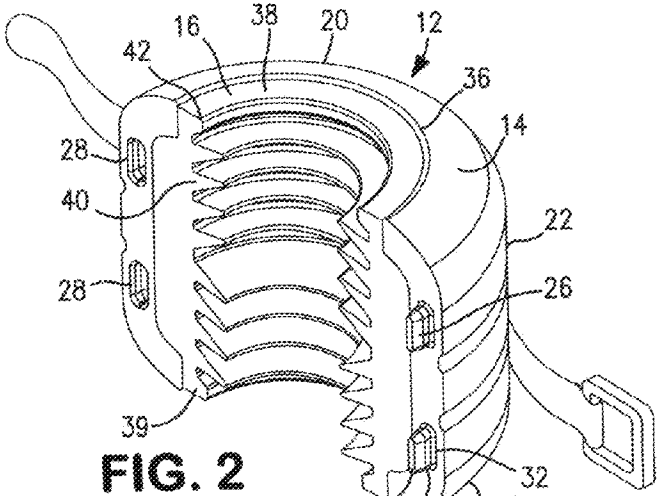
FIG. 2 is a perspective view of another, mating component part of the knob simulating device of the present invention.
Figure 1:
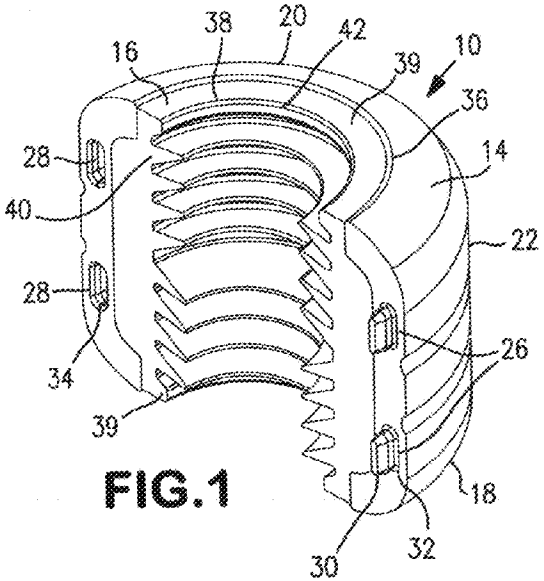
FIG. 1 is a perspective view illustrating one component part of the knob simulating device of the present invention.

Turning first to FIGS. 1 and 2, there is shown perspective views of component parts 10, 12 that make up the completed knob simulating device of the present invention. Since most of the features of the component parts are the same, like identification numbers are used for the same features of the component parts 10, 12. The component parts 10, 12 both have a generally cylindrical, hard exterior portion 14, that may be made of a hard plastic such as nylon and a resilient interior portion 16 that may be comprised of an elastomeric material.

As shown in the exemplary embodiment, the present invention is described in terms of a baseball bat, however, it will be seen that the present invention can be applicable to other sporting goods, such as golf clubs, lacrosse sticks and the like.

Accordingly, taking first the exterior portion 14, the purpose of the exterior portion 14 is to contain the soft, resilient inner portion 16 as well as to provide the shape and feel of a simulated bat knob. Because the normal knob of a baseball bat is hard, the knob simulating device must also be hard, if it is to simulate the knob of a bat. Ideally, it will be made from a hard, tough, thermoplastic material such as an impact resistant Nylon. The exterior portion 14 can be manufactured by the injection molding process.

In the exemplary embodiment, the exterior portion 14 is semi-cylindrical and resembles a can cut in half along its long axis, however, as explained, there may be more than two component parts that make up the knob simulating device that add up to 360 degrees around the outer, generally cylindrical surface of a baseball bat.

Each of the component parts 10, 12 has a proximal end 18 that faces the normal bat knob, when installed on a baseball bat, and a distal end 20 that faces the barrel of the bat. The exterior surfaces 22 of the component parts 10, 12 are rounded with a common radius that is close to that of a typical knob of a baseball bat.

In order to provide an alignment of the component parts 10, 12 when assembled together, there may be one or more protrusions 26 formed on each component part 10, 12 that interfit into one or more recesses 28 formed on the other component part 10, 12. The protrusions 26 each have a tip 30 that is narrower than the base 32 of the protrusions 26 and serve to guide the protrusions 26 into the mating recesses 28. The recesses 28 include an entrance 34 that is wider than the rest of the recess 28 such that the entrance 34 serves to guide a mating tip 30 into a recess 28.

The inner diameter 36 of the exterior portion 14 is sized so that it will not interfere with the largest typical baseball bat shaft size. Because the exterior portions 14 are so sized, the complete knob simulating device can be assembled around a typical baseball bat shaft.

Taking then, the interior portion 16 of a component part 10, 12, the interior portion 16 is a cylindrical configuration that surrounds the exterior of the bat shaft so as to retain the component parts 10, 12 to the bat shaft. While the interior portion 16 may simply be cylindrical, in the exemplary embodiment, the inner portion 16 may be comprised of at least one deformable projection 38 that extends inwardly, and, there may be a plurality of deformable projections 38 extending inwardly, generally radially, on each of the component parts 10, 12.

In the exemplary embodiment, the deformable projections 38 are concentric, annular rings. Each of annular rings is preferable triangular in cross sectional shape, having a base 40 that is thicker that the tip 42. The rings are angled when compared to a line perpendicular to the ring axis such that when a force is applied along the line that is perpendicular to the ring axis, the deformable projections 38 will deflect in a predetermined direction and perform the function of a cantilevered spring. As shown, about one half of the deformable projections 38 are angled towards the proximal end 18 of the component part and the other half of the deformable projections 38 are angled toward the distal end 20 of the component parts 10, 12.

Figure 3:
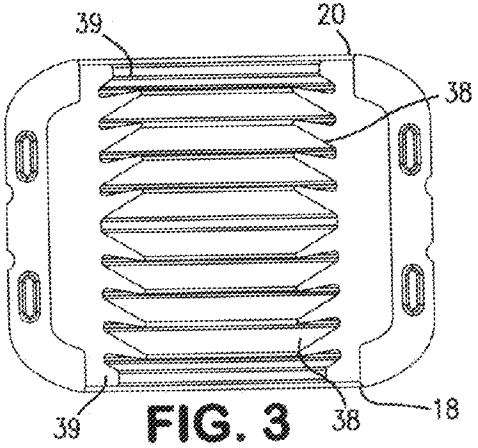
FIG. 3 is a side view illustrating the interior of one of the components of the knob simulating device of FIG. 1 or FIG. 2.

Turning then to FIG. 3, taken along with FIGS. 1 and 2, there can be seen the angular orientation of the deformable projections 38 such that one half of the angular projections 38 are angled toward the proximal end 18 and the other half are angled toward the distal end 20 of the component part 10. As can be seen, it is preferred that the particular half of the annular projections 38 be angled in the direction of the closest end of the component part 10.

The deformable projections 28 serve several purposes. One such purpose is to serve as springs and maintain pressure on a variety of different diameter shafts when the knob simulating device is assembled around the shaft of a baseball bat and which is later explained.

Because the deformable projections 38 will interfere with the larger bat shaft when the device is assembled around that shaft, there will be a pressure and force that develops between the deformable projections 38 and the bat shaft. That pressure and force will tend to hold the knob simulating device in place along the shaft of the baseball bat.

Another purpose is to resist movement up and down the shaft of the baseball bat and provide support for the batter's hands, again, as will be later explained. Preferably, the deformable projections 38 are made from a soft thermoplastic elastomer such as a soft santoprene. The deformable projections 38 may be over-molded onto the inner surfaces of the exterior portion 14.

The inner diameters of the deformable projections 38 are sized so that the deformable projections 38 will interfere with the smallest typical bat shaft size, when the knob simulating device is assembled around that shaft. Because the deformable projections 38 will interfere with the smallest typical bat shaft size, and because they perform the function of a cantilevered spring, they will deflect, and maintain a pressure and force on the shaft of the smallest typical bat shaft size. That pressure and force will tend to hold the knob simulating device in place upon the bat shaft. Because the deformable projections 38 are angled when compared to a line perpendicular to the ring axis, they are biased to resist movement of the knob simulating device in one direction more than in another, and provide increased resistance to movement of the knob simulating device along the shaft.

The outermost (top and bottom) deformable projections 39 terminate at a larger diameter than the other deformable projections 38. This prevents the outermost (top and bottom) deformable projections 39 from extending upwards iii an unsightly manner and, instead, presents an aesthetic, clean appearance, when pressed against a bat shaft.

The pressure and force against the bat shaft can also be developed in other manners, such as an inflatable bladder that takes the place of the elastomeric material, or the use of "memory foam" or removable sleeves, etc.

Figure 4:
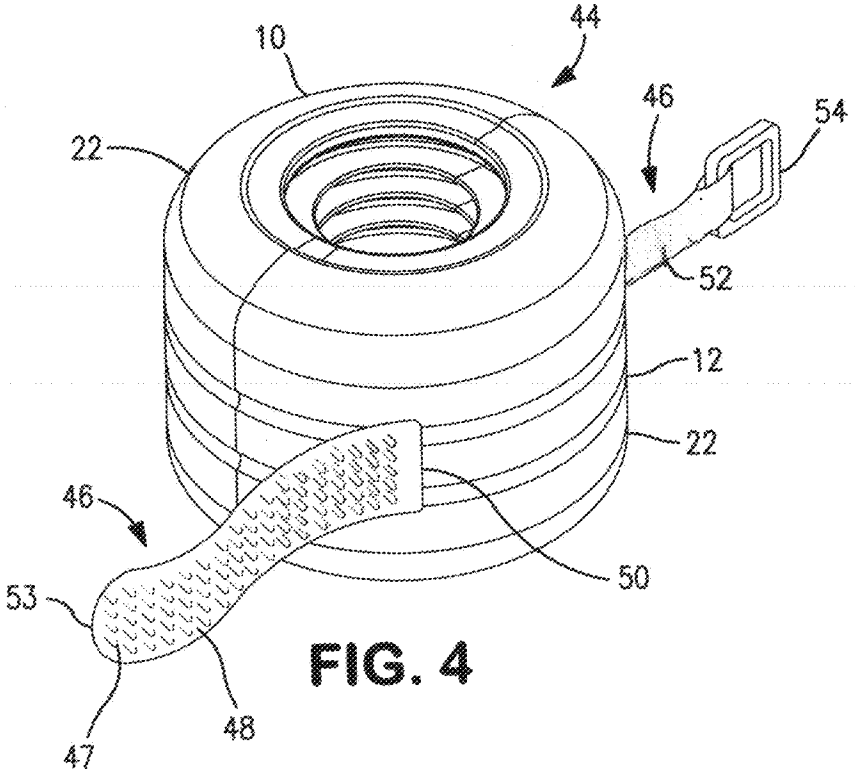
FIG. 4 is a perspective view of the completed knob simulating device of the present invention with a securing device in the unsecured orientation.

Turning then to FIG. 4, taken along with FIGS. 1-3, the two component parts 10, 12, as can be seen, are affixed together to make up a completed knob simulating device 44, however, there may more than two component parts and still be within the scope of the present invention. The exterior surfaces 22 are complementary and shaped so as to simulate the bat knob normally formed at the proximal end of a baseball bat.

At least one of the two mating component parts 10, 12 can have a securing device 46 that enhances the attachment or affixation between the component parts 10, 12. In FIG. 4, the securing device 46 is shown on the component part 12 in the form of a fabric strap 48 with hook and loop system 47 on the fabric strap 48.

The fabric strap 48 is affixed to the component part 12 and is secured therein. One means of such affixation is to pass the fabric strap 48 through a channel 50 formed in one of the component parts, such as component part 12 such that the fabric strap 48 is secured therein. There is a D-ring 54 affixed to one end 52 of the fabric strap 48.

As such, the other end 53 of the fabric strap 48 can be looped through the D-ring 54 and attached to itself by means of the hook and loop system 47 to secure one component part 10 to the other component part 12 by having the fabric strap 48 attached to component 12 encircle the component part 10, pass through the D-ring 54 and attach to itself by means of the hook and loop system.

Other securing devices or methods may be used to aid in the attachment of the component parts 10, 12. That attachment device may be any one of the following: two fabric straps, a hook(s) with a mating recess, a latch(s) with a mating protrusion, an adhesive, a snap, a friction fit, a magnet, an elastic band, a threaded member and mating threaded hole, a rigid or semi rigid collar or any combination of the above means of attachments or other attachment device.

Figure 5:
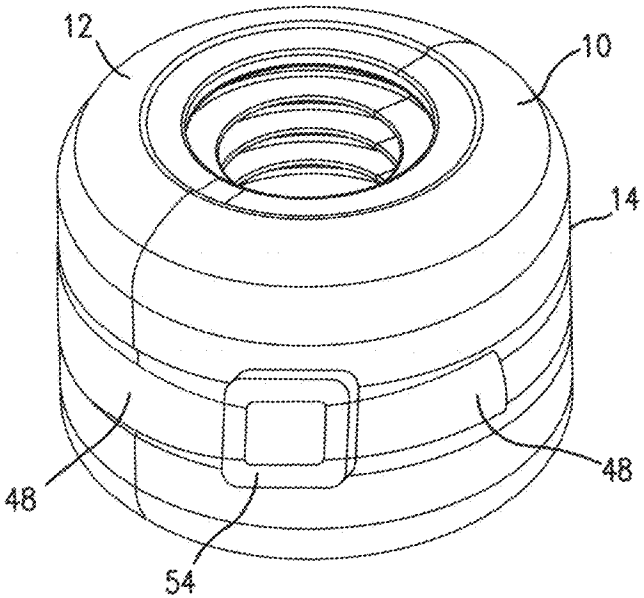
FIG. 5 is a perspective view of the completed knob simulating device of the present invention with a securing device in the secured orientation.

Turning to FIG. 5, the completed simulated bat knob 44 is shown where the two components 10, 12 have been secured together and the securing means is in the secured orientation where the fabric strap 48 has passed through the D-ring 54 and has been secured to itself by means of a hook and loop system along its length or portion thereof.

Figure 6:
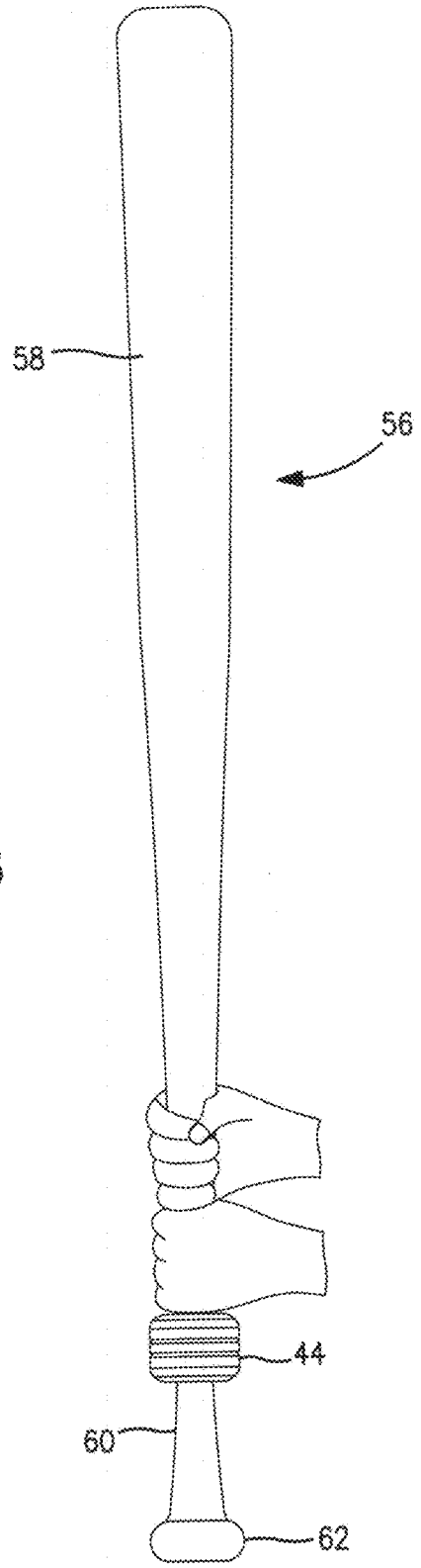
FIG. 6 is a front view of a knob simulating device of the present invention affixed to a baseball bat.

Turning finally to FIG. 6, there is shown a perspective view of a baseball bat 56 to which a knob simulating device 44 has been attached.

As can be seen in FIG. 6, the baseball bat 56 includes a barrel 58, a shaft 60 and a knob 62. The player's hands 64 are grasping the shaft 60 of the baseball bat 56 such that the lower hand is contacting the knob simulating device 44 and thus has the familiar feeling to the player gripping the bat against the knob 62 but, as can be seen, the knob simulating device 44 allows the player to choke up on the bat and still have the comfortable feel of contacting the knob simulating device knob 44. In addition, as explained, the player can consistently choke up to the same position of the baseball bat 56 by retaining the knob simulating device 44 at the same position. Obviously, however, for different players or to enable a player to change his choked up location, the knob simulating device 44 can be removed and replaced at some other location along the bat shaft 60.

Referring now to FIGS. 1-6, to use the device, the two components 10, 12 are assembled around the shaft 60 of the bat 56, at the location that the user desires the knob simulating device 44 to be positioned. While assembling the components 10, 12, protrusions 26 enter recesses 28 and register the two components 10, 12 to each other. To secure the two components 10, 12 together the fabric strap 48 is passed through the 'D' ring 54 and folded back on itself, such that the hook and loop system prevents the strap 48 from becoming insecure.

The securing device can also take any other means of attachment, such as a living hinge to join the two components 10, 12 together and plastic snaps to hold them closed, to each other, to form a cylinder. Once in place, the knob simulating device 44 provides a fixed location for the user to consistently position his hands in the same location. Furthermore, the knob simulating device 44 will provide the batter with support, during his swing.

Alternately, the two components 10, 12 could be connected together and made as one part, joined by a plastic "living hinge", or another type of hinging device, that assists assembly around the bat shaft.

Those skilled in the art will readily recognize numerous adaptations and modifications which can be made to the knob simulating device of the present invention which will result in an improved batting performance utilizing the same, yet all of which will fall within the scope and spirit of the present invention as defined in the following claims. Accordingly, the invention is to be limited only by the following claims and their equivalents.

What is claimed is:

1. A device that encircles a shaft of a sporting good having a generally cylindrical outer surface, the device having a distal end and a proximal end and being comprised of two component parts having ends, wherein the ends of one of the component parts mate together with the ends of the other of the component parts to encircle the shaft and provide a hard exterior surface with at least one component part having a resilient interior portion for contacting and conforming to the circular outer surface of the sporting good, the resilient interior portion having a configuration that contacts and retains the device along the circular outer surface of the sporting good, the resilient interior portion comprising a plurality of inwardly directed deformable projections wherein some of the plurality of inwardly directed deformable projections are slanted in the direction toward the distal end and some of the inwardly directed deformable projections are slanted in the direction toward the proximal end.

2. The device of claim 1 wherein the resilient portion is generally cylindrical.

3. The device of claim 1 wherein the component parts mate together to form a generally cylindrical device.

4. The device of claim 1 wherein the sporting good is a baseball bat.

5. The device of claim 1, wherein about one half of the inwardly directed deformable projections are slanted toward the distal end and about one half of the inwardly directed deformable projections are slanted toward the proximal end.

6. The device of claim 1 wherein the inwardly deformable projections are annular rings.

7. The device of claim 1 wherein the device further includes a securing device to secure the two component parts together.

8. The device of claim 7 wherein the securing device comprises a strap that is affixed to one of the component parts and that encircles the other component part.

9. The device of claim 1 wherein each of the component parts has an interlocking protrusion or recess that locks with a corresponding recess or protrusion on the other component part.

10. The combination of a baseball bat and a knob simulating device affixed thereto, the baseball bat having a proximal end forming a knob, a distal end forming a barrel and an intermediate portion forming a shaft having a cylindrical outer surface, the knob simulating device being affixed to the shaft, the knob simulating device comprising two parts having ends, wherein the ends of one of the component parts mate with the ends of the other of the component parts to form a generally cylindrical device surrounding the shaft, each component part having a hard exterior portion and a resilient interior portion for contacting and conforming to the generally cylindrical outer surface of the shaft, the resilient interior portion retaining the knob simulating device along the generally cylindrical outer surface of the shaft, wherein the resilient interior portion comprises a plurality of inwardly directed deformable projections and wherein some of the plurality of inwardly directed deformable projections are slanted in the direction toward the distal end of the baseball bat and some of the inwardly directed deformable projections are slanted in the direction toward the proximal end of the baseball bat.

11. The combination of claim 10 wherein the device further includes a securing device to secure the two component parts together.

12. The combination of claim 11 wherein the securing device includes a strap that connects between the two component parts.

13. A device that encircles a shaft of a sporting good having a generally cylindrical outer surface, the device having a distal end and a proximal end and being comprised of a plurality of component parts that mate together to encircle the shaft and provide a hard exterior surface with at least one component having a resilient interior portion comprising a plurality of inwardly directed deformable projections, for contacting and conforming to the circular outer surface of the sporting good, wherein some of the plurality of inwardly directed deformable projections are slanted in the direction toward the distal end and some of the inwardly directed deformable projections are slanted in the direction toward the proximal end to contact and retain the device along the circular outer surface of the sporting good.

14. The device of claim 13 wherein about one half of the inwardly directed deformable projections are slanted toward the distal end and about one half of the inwardly directed deformable projections are slanted toward the proximal end.

15. The combination of a baseball bat and a knob simulating device affixed thereto, the baseball bat having a proximal end forming a knob, a distal end forming a barrel and an intermediate portion forming a shaft having a cylindrical outer surface, the knob simulating device being affixed to the shaft, the knob simulating device comprising a plurality of component parts that mate together to form a generally cylindrical device surrounding the shaft, each component part having a hard exterior portion and a resilient interior portion for contacting and conforming to the generally cylindrical outer surface of the shaft, the resilient interior portion comprising a plurality of inwardly directed deformable projections wherein some of the plurality of inwardly directed deformable projections are slanted in the direction toward the distal end of the baseball bat and some of the inwardly directed deformable projections are slanted in the direction toward the proximal end of the baseball bat, the resilient portion retaining the knob simulating device along the generally cylindrical outer surface of the shaft.

* * * * *